US009936324B2

(12) United States Patent
Ochiai et al.

(10) Patent No.: US 9,936,324 B2
(45) Date of Patent: Apr. 3, 2018

(54) SYSTEM AND METHOD FOR GENERATING SPATIAL SOUND USING ULTRASOUND

(71) Applicant: Pixie Dust Technologies, Inc., Tokyo (JP)

(72) Inventors: Yoichi Ochiai, Tokyo (JP); Takayuki Hoshi, Tokyo (JP)

(73) Assignee: Pixie Dust Technologies, Inc., Tokyo (JP)

( * ) Notice: Subject to any disclaimer, the term of this patent is extended or adjusted under 35 U.S.C. 154(b) by 0 days.

(21) Appl. No.: 15/089,879

(22) Filed: Apr. 4, 2016

(65) Prior Publication Data

US 2017/0289722 A1 Oct. 5, 2017

(51) Int. Cl.

| | |
|---|---|
| ***H04R 1/40*** | (2006.01) |
| ***H04S 7/00*** | (2006.01) |
| *H04S 1/00* | (2006.01) |

(52) U.S. Cl.

CPC ..... *H04S 7/30* (2013.01); *H04R 2217/03* (2013.01); *H04S 1/002* (2013.01); *H04S 2400/11* (2013.01)

(58) Field of Classification Search

CPC ..... H04R 3/12; H04R 19/02; H04R 2217/07; H04R 2217/03; H04S 1/002; H04S 7/30; H04S 2400/11

USPC ..... 381/77, 79, 97

See application file for complete search history.

(56) References Cited

U.S. PATENT DOCUMENTS

| | | | | |
|---|---|---|---|---|
| 7,760,891 | B2 * | 7/2010 | Biegelsen | H04R 1/403 367/103 |
| 2007/0223724 | A1 * | 9/2007 | Miyazaki | H04R 3/00 381/77 |
| 2008/0159571 | A1 * | 7/2008 | Hooley | H04R 1/403 381/307 |
| 2009/0214049 | A1 * | 8/2009 | Lee | H04R 1/40 381/71.1 |
| 2014/0269538 | A1 * | 9/2014 | Dang | H04W 28/0247 370/329 |

FOREIGN PATENT DOCUMENTS

JP 2009-290253 A 12/2009

OTHER PUBLICATIONS

Masahide Yoneyama et al., "The Audio Spotlight: An Application of Nonlinear Interaction of Sound Waves to a New Type of Loudspeaker Design", The Journal of the Acoustical Society of America, vol. 73, No. 5, pp. 1532-1536 (May 1983).

(Continued)

*Primary Examiner* — Disler Paul

(74) *Attorney, Agent, or Firm* — Amster, Rothstein & Ebenstein, LLP

(57) ABSTRACT

A novel system and method for spatial sound generation is disclosed. A system and method for generating bodiless mid-air speakers includes the steps of: generating a modulated signal by modulating an ultrasonic carrier signal with an audio signal, determining a phase delay value for each ultrasonic transducer of an array of ultrasonic transducers with respect to one or more focal points, and driving each such ultrasonic transducer with the modulated signal in accordance with the phase delay value determined for each ultrasonic transducer to generate audible sound at the one or more focal points.

8 Claims, 12 Drawing Sheets

(56) References Cited

OTHER PUBLICATIONS

Yoichi Ochiai et al., "Fairy Lights in Femtoseconds: Aerial and Volumetric Graphics Rendered by Focused Femtosecond Laser Combined with Computational Holographic Fields", in ACM SIGGRAPH 2015 Emerging Technologies (SIGGRAPH '15). ACM, New York, NY, USA, Article 10 , 1 pages. DOI=http://dx.doi.org/10.1145/2782782.2792492.

Yoichi Ochiai et al., "Pixie dust: graphics generated by levitated and animated objects in computational acoustic-potential field", ACM Transactions on Graphics (TOG)—Proceedings of ACM SIGGRAPH 2014, vol. 33, No. 4, Article 85 (Jul. 2014), 13 pages. DOI=http://dx.doi.org/10.1145/2601097.2601118.

Takayuki Hoshi et al., "Noncontact tactile display based on radiation pressure of airborne ultrasound", IEEE Transactions on Haptics, vol. 3, No. 3, pp. 155-165 (2010).

Takayuki Hoshi, "Compact ultrasound device for noncontact interaction", Advances in Computer Entertainment vol. 7624 of the series Lecture Notes in Computer Science, pp. 502-505,Springer (2012).

Jun Yang et al., "Acoustic beamforming of a parametric speaker comprising ultrasonic transducers", Sensors and Actuators A: Physical, vol. 125, Issue 1, pp. 91-99 (Oct. 2005).

Woon-Seng Gan et al., "A Digital Beamsteerer for Difference Frequency in a Parametric Array", IEEE Transactions on Audio, Speech, and Language Processing, vol. 14, No. 3 (May 2006).

* cited by examiner

Dot

Line

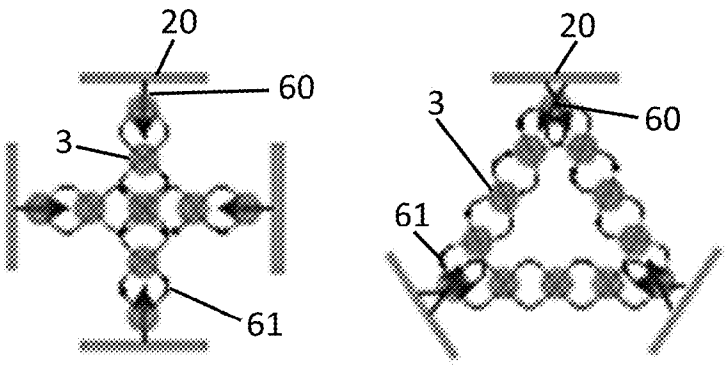
Cross
FIG. 8C
Triangle
FIG. 8D
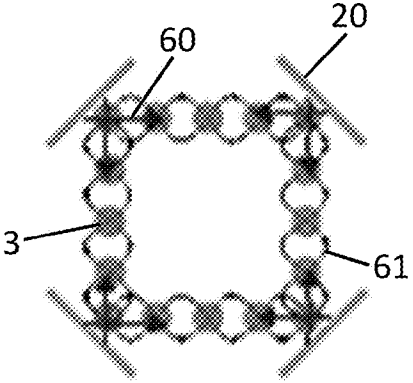
Square
FIG. 8E
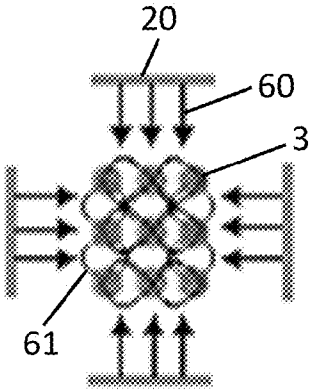
2D Grid
FIG. 8F

SYSTEM AND METHOD FOR GENERATING SPATIAL SOUND USING ULTRASOUND

FIELD OF THE INVENTION

The present invention generally relates to a three-dimensionally localized sound source. More particularly, the present invention relates to a system and a method by which the distribution of an ultrasonic field is focused at an arbitrary point in space to generate audible sound.

BACKGROUND

Ultrasound can be modulated to generate audible sound in air based on a well-known phenomenon that is referred to as the nonlinear interaction of sound waves or the scattering of sound by sound. The nonlinearity of air provides for a self-demodulation effect. Ultrasound waves can be modulated by an audio signal and radiated from a transducer array into the air as primary waves. The modulated ultrasound waves interact in a nonlinear fashion in air. As a result, they are demodulated and produce the audio signal used to modulate the ultrasound waves.

This principle has been applied to create directed speakers that have a very defined directivity pattern, which it makes it possible to realize an acoustic spotlight. See Yoneyama, M., et al. "The Audio Spotlight: An Application Of Nonlinear Interaction Of Sound Waves To A New Type Of Loudspeaker Design". *J. Acoust. Soc. Am.* 73 (5), May 1983. (hereby incorporated by reference in its entirety). Conventional superdirective speakers, e.g., parametric speakers, emit modulated ultrasound waves in a narrow beam so that the demodulated audio can only be heard within the beam. Audio is created at an infinite number of points all along the ultrasonic beam.

Conventional parametric speakers use an ultrasonic transducer to project an ultrasonic carrier signal modulated with an audio signal in a collimated beam. Such speakers typically include a modulator for modulating an ultrasonic carrier signal with an audio signal, a driver amplifier for amplifying the modulated carrier signal, and at least one ultrasonic transducer for projecting the modulated carrier signal through the air as a sound beam. Because of the non-linear propagation characteristics of air, the projected modulated carrier signal is demodulated as it passes through the air, thereby generating the audio signal along the beam path.

Anyone in the path of the collimated ultrasonic beam can hear the demodulated audio. It is desirable to have a directed speaker that can target particular individuals. Attempts to direct audio to specific individuals include installing conventional parametric speakers overhead in the ceiling. However, this solution suffers from various drawbacks, including the impracticality of such installations and high power consumption. Moreover, conventional parametric speakers may not be able to seamlessly deliver audio to a particular individual as the individual is moving.

SUMMARY

Systems and methods for generating a point source of sound in air are provided. In accordance with the embodiments of the present invention, a bodiless mid-air sound source is generated by focusing an acoustic field at a particular spatial position.

Furthermore, by manipulating the acoustic field, the spatial position of a bodiless mid-air sound source can be changed. Accordingly, new avenues in the field of sound generation and presentation will be opened.

According to one aspect of this invention, a method for generating bodiless mid-air speakers includes the steps of: generating a modulated signal by modulating an ultrasonic carrier signal with an audio signal, determining a phase delay value for each ultrasonic transducer of an array of ultrasonic transducers with respect to one or more focal points, and driving each such ultrasonic transducer with the modulated signal in accordance with the phase delay value determined for each ultrasonic transducer to generate audible sound at the one or more focal points.

According to another aspect of this invention, the ultrasonic carrier signal is a sine wave having a frequency of at least 20 kHz.

According to another aspect of this invention, the phase delay value for each ultrasonic transducer is determined in accordance with the equation $\Delta t_{ij}=(l_{00}-l_{ij})/c$, wherein $\Delta t_{ij}$ represents a time delay for the application of a drive signal to an ultrasonic transducer.

According to another aspect of this invention, the phase delay value for each ultrasonic transducer is determined in accordance with equation $U_h(x, y)=\alpha_h(x, y) \exp [i\varphi_h(x, y)]$, where $\varphi_h$ (x, y) represents the phase delay value.

According to another aspect of this invention, the modulated signal is generated by amplitude modulation.

According to another aspect of this invention, the modulated signal is generated by frequency modulation.

According to another aspect of this invention, the audible sound can only be heard within about 50 cm of the one or more focal points.

According to another aspect of this invention, the one or more focal points are adjacent to a person's ear.

According to another aspect of this invention, the one or more focal points are adjacent to an object or image so as to make it appear as if the object or image is the source of the audible sound.

According to another aspect of this invention, the method for generating bodiless mid-air speakers further includes the steps of: changing the spatial position of one or more focal points, determining a new phase delay value for each ultrasonic transducer of an array of ultrasonic transducers with respect to the one or more focal points, and driving each ultrasonic transducer with the modulated signal in accordance with the new phase delay value determined for each ultrasonic transducer to generate audible sound at the one or more focal points.

According to another aspect of this invention, a bodiless mid-air speakers generator includes: one or more ultrasonic phased arrays, each ultrasonic phase array including: an array of ultrasonic transducers, a signal generator for generating a modulated signal by modulating an ultrasonic carrier signal with an audio signal, a phase delay calculator for determining a phase delay value for each ultrasonic transducer of the array of ultrasonic transducers with respect to one or more focal points, and a driving circuit for applying the modulated signal to each ultrasonic transducer in accordance with the phase delay value determined for each such ultrasonic transducer to generate audible sound at the one or more focal points.

According to another aspect of this invention, the bodiless mid-air speakers generator, wherein the ultrasonic carrier signal is a sine wave having a frequency of at least 20 kHz.

According to another aspect of this invention, the bodiless mid-air speakers generator, wherein the phase delay value for each ultrasonic transducer is determined in accordance with the equation $\Delta t_{ij}=(l_{00}-l_{ij})/c$, wherein $\Delta t_{ij}$ represents a time delay for the application of a drive signal to an ultrasonic transducer.

According to another aspect of this invention, the bodiless mid-air speakers generator, wherein the phase delay value for each ultrasonic transducer is determined in accordance with equation $U_h(x, y)=\alpha_h(x, y) \exp [i\varphi_h(x, y)]$, where $\varphi_h(x, y)$ represents the phase delay value.

According to another aspect of this invention, the bodiless mid-air speakers generator, wherein the signal generator comprises an amplitude modulation unit.

According to another aspect of this invention, the bodiless mid-air speakers generator, wherein the signal generator comprises a frequency modulation unit.

According to another aspect of this invention, the bodiless mid-air speakers generator, further comprising an output power control circuit to adjust the volume of the audible sound.

According to another aspect of this invention, the bodiless mid-air speakers generator, wherein each phased array has at least 285 ultrasonic transducers.

According to another aspect of this invention, the bodiless mid-air speakers generator, wherein the phase delay calculator determines a new phase delay value for each ultrasonic transducer of the array of ultrasonic transducers with respect to any change in the spatial position of the one or more focal points.

According to another aspect of this invention, a method for generating bodiless mid-air speakers including the steps of generating a first modulated signal by modulating an ultrasonic carrier signal with a first audio signal, generating a second modulated signal by modulating an ultrasonic carrier signal with a second audio signal, determining a phase delay value for each ultrasonic transducer of a first group of transducers of an array of ultrasonic transducers with respect to a first focal point, determining a phase delay value for each ultrasonic transducer of a second group of transducers of the array of ultrasonic transducers with respect to a second focal point, driving each such ultrasonic transducer of the first group of transducers with the first modulated signal in accordance with the phase delay value determined for each such ultrasonic transducer of the first group to generate audible sound at the first focal point; and driving each such ultrasonic transducer of the second group of transducers with the second modulated signal in accordance with the phase delay value determined for each such ultrasonic transducer of the second group to generate audible sound at the second focal point.

BRIEF DESCRIPTION OF THE DRAWINGS

Various exemplary embodiments of this invention will be described with reference to the following figures, wherein:

FIG. 8C shows a cross-shaped acoustic field in accordance with embodiments of the present invention;

FIG. 8D shows a triangle-shaped acoustic field in accordance with embodiments of the present invention;

FIG. 8E shows a square-shaped acoustic field in accordance with embodiments of the present invention; and FIG. 8F shows a two dimensional grid-shaped acoustic field in accordance with embodiments of the present invention;

DETAILED DESCRIPTION

In accordance with the embodiments of the present invention disclosed and described herein, sound sources are created at arbitrary points in space, i.e., bodiless mid-air speakers.

Conventional parametric speakers utilize the nonlinear interaction of finite amplitude ultrasonic waves in air to generate a directed beam of audible sound. A parametric speaker radiates a beam of high-intensity ultrasound which is the superposition of spherical waves from multiple transducers. When two finite amplitude sound waves (primary waves) having different frequencies interact with one another in air, new sound waves (secondary waves) whose frequencies correspond to the sum and the difference of the primary waves can be produced. This phenomenon is based on nonlinear acoustics of sound wave interaction in air. The principle of sound generation from ultrasound is expressed in the following equation:

$$\left(\nabla^2 - \frac{1}{c_0^2}\frac{\partial^2}{\partial t^2}\right)p_s = -\frac{\beta}{\rho_0 c_0^4}\frac{\partial^2}{\partial t^2}p_1^2 \tag{1}$$

where $p_s$ is the secondary wave sound pressure, $p_1$ is the primary wave sound pressure, $\beta$ is the nonlinear fluid parameter, and $c_0$ is the small signal sound velocity. The left side is an equation of the generated audible sound $p_s$ and the right side is an equation of the driving ultrasound source $p_1$. This derived wave equation determines the sound pressure of secondary waves produced by the nonlinear interaction. It means that a space filled with high-amplitude modulated ultrasound waves can act as a sound source.

The present invention utilizes the principle of sound generation embodied in Eq. (1) to generate a point source of audible sound. Ultrasonic carrier signals are modulated with an audio signal and the modulated ultrasonic carrier signals are directed to a focal point in the air where the modulate ultrasonic carrier signals interact to regenerate the audio signal of sufficiently high intensity to generate audible sound at the focal point.

Figure 1A:
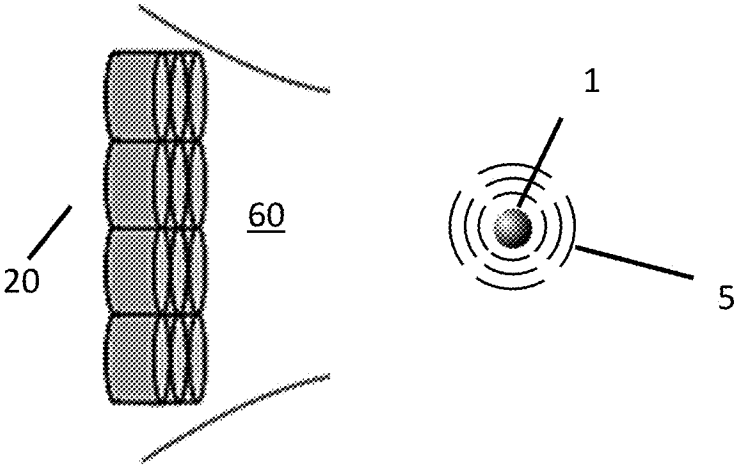
FIG. 1A shows a bodiless mid-air sound source generated in an ultrasonic field in accordance with an embodiment of the present invention.

As shown in FIG. 1A, an array of transducers 20 is controlled to direct an acoustic beam 60 at a focal point so that a bodiless mid-air sound source 1 is created at that point to emit an audible sound 5. The output power of ultrasonic phased array can be controlled so that the generated sound is only audible around the focal point.

Figure 2:
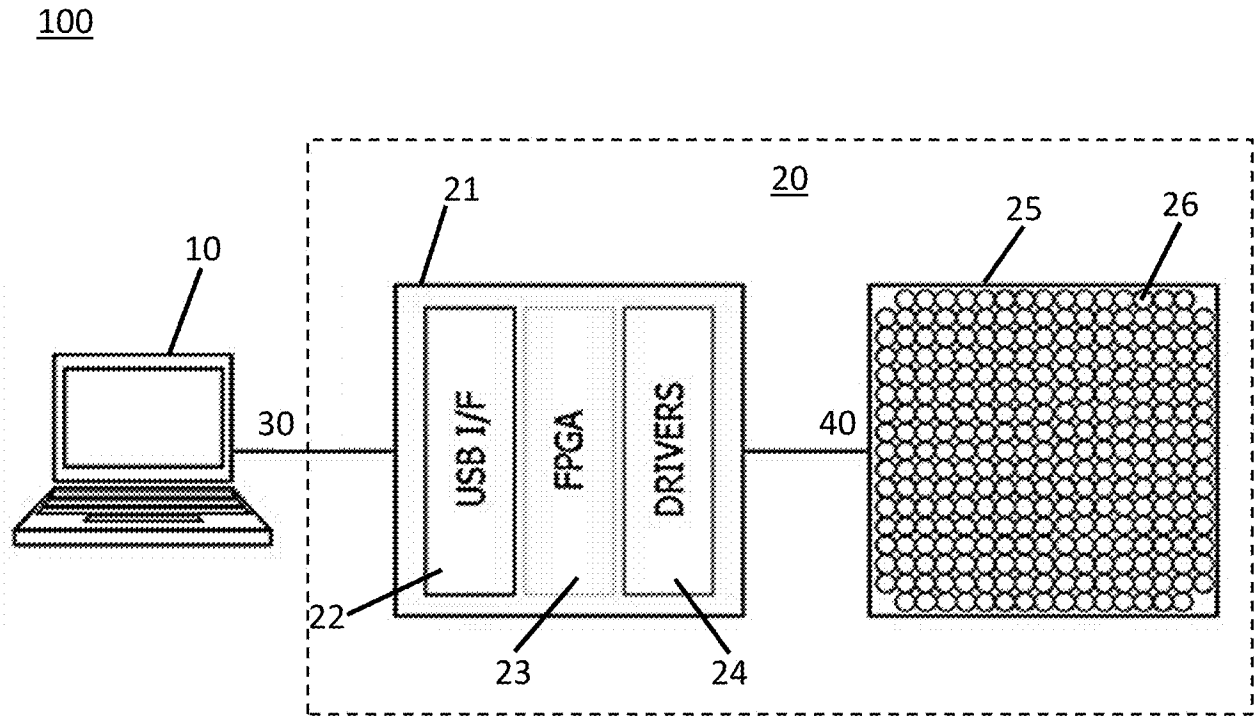
FIG. 2 shows a system for generating a point sound source in an acoustic field in accordance with an embodiment of the present invention.
Figure 3:
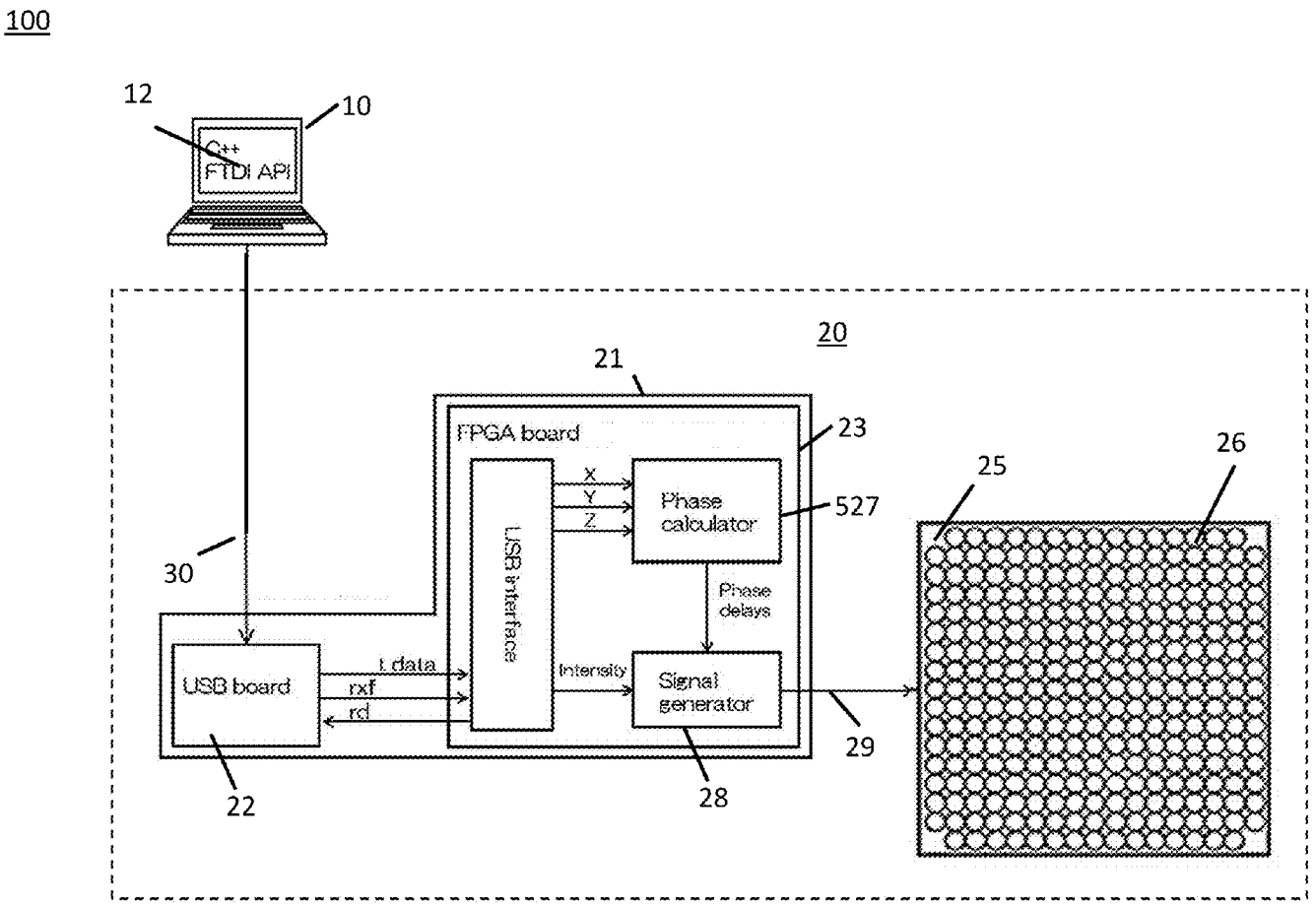
FIG. 3 shows the system of FIG. 2 in additional detail.
Figure 4:
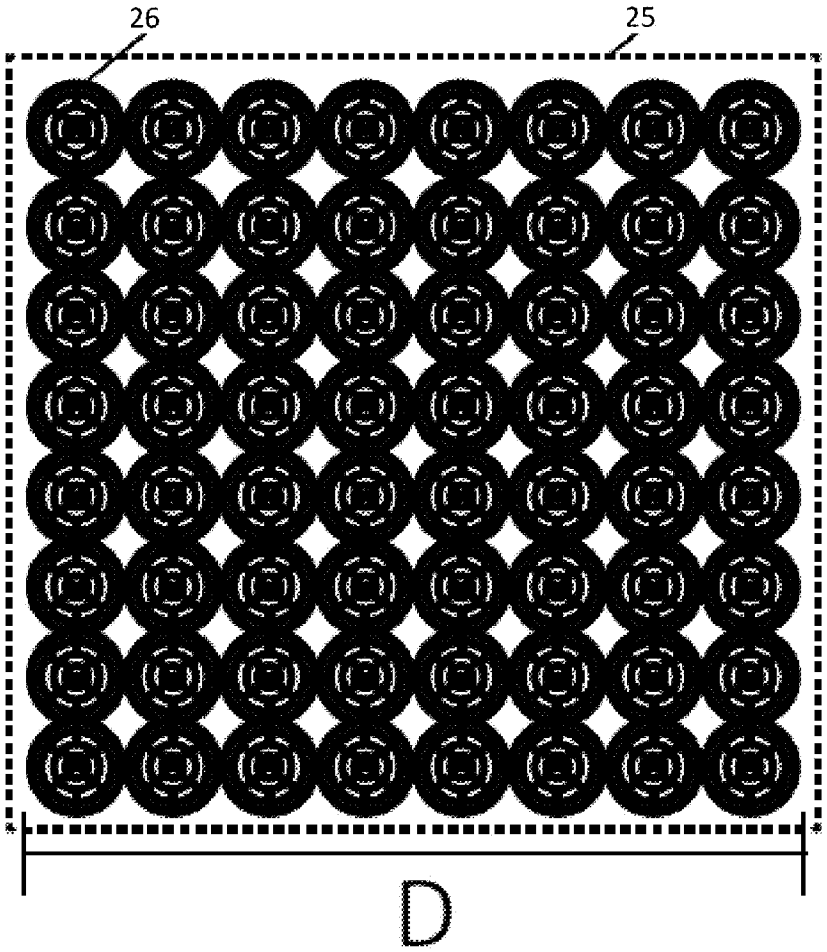
FIG. 4 shows an ultrasonic phased array in accordance with the embodiments of the present invention.

FIG. 2 shows an exemplary embodiment of a system 100 in accordance with the present invention. The system 100 includes a system controller 10 and one or more ultrasonic phased arrays 20. The system controller 10 controls each one of the ultrasonic phased arrays 20 via a USB cable 30. Referring to FIG. 3, the system controller 10 controls the system 100 under the direction of a control application 12 to effect desired changes in the acoustic field that is generated by the one or more ultrasonic transducer arrays 20. In an embodiment in accordance with the present invention, the control application 12 is developed in C++ on the WINDOWS operating system.

Each phased array 20 consists of two circuit boards 21, 25. The first circuit board is an array 25 of ultrasonic transducers 26. The second circuit board contains the driving circuitry 21 which drives the ultrasonic transducers 26. The driving circuitry 21 includes a USB interface circuit 22, a field-programmable gate array FPGA 23, and drivers 24. The two circuit boards—and hence the transducer array 25 and the driving circuitry 21—are connected to each other with pin connectors 40.

Figure 5:
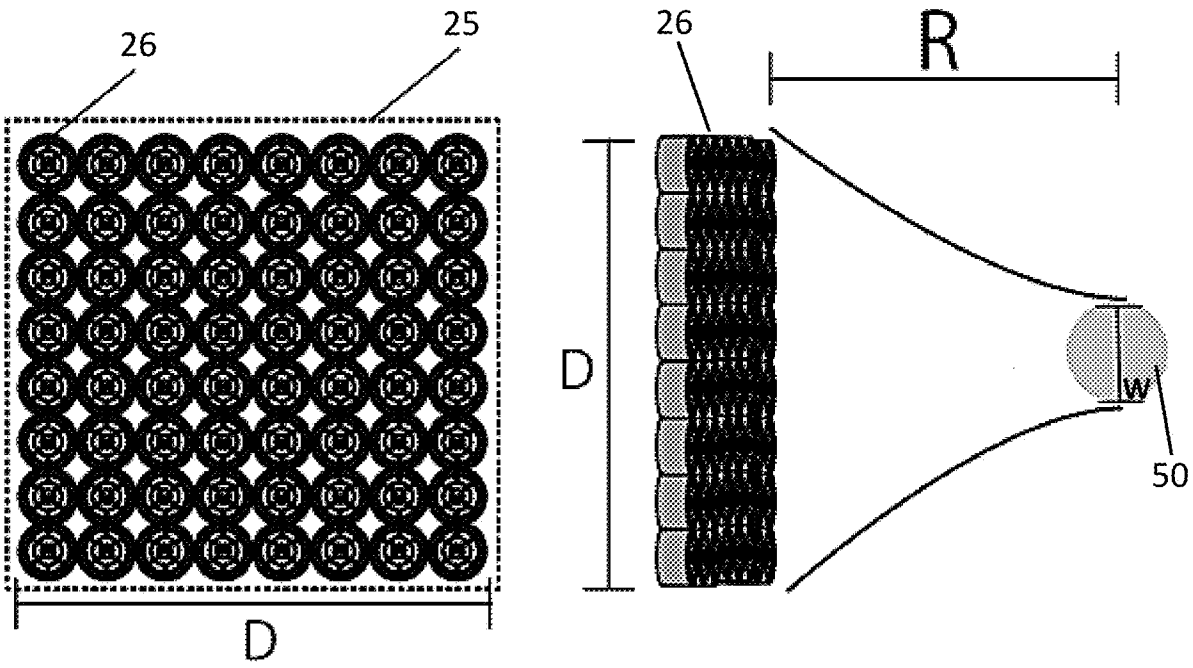
FIG. 5 shows the generation of a focal point by an ultrasonic phased array in accordance with the embodiments of the present invention.

As shown in FIG. 5, each array 25 of ultrasonic transducers 26 has a side length D and has a plurality of ultrasonic transducers 26, each of which is controlled separately with a calculated time or phase delay and intensity value. The time or phase delay is calculated based on the relative position between an ultrasonic transducer and one or more points in space where audio signals are generated. The intensity value is derived based on the audio signals that are to be generated. These values are applied by the driving circuitry 21. In this way, each array 25 of ultrasonic transducers 26 generates a single focal point or other distributions of ultrasound (e.g., multiple focal points and a focal line) to form one or more bodiless mid-air sound sources. In a preferred embodiment, the size and weight of a single phased array 20 are 19×19×5 $cm^3$ and 0.6 kg, respectively.

In presently preferred embodiments, the ultrasonic phased array 20 can have a frequency of either 40 kHz or 25 kHz. The position of the focal point is digitally controlled with a resolution of 1/16 of the wavelength (approximately 0.5 mm for the 40-kHz ultrasound) and can be refreshed at 1 kHz. In an embodiment in accordance with the present invention, an ultrasonic phased array 40 has a frequency of 40 kHz and consists of 285 transducers, each of which has a diameter of 10-mm diameter. An exemplary 40-kHz transducer bears model number T4010A1 and is manufactured by Nippon Ceramic Co., Ltd. The ultrasonic transducers are arranged in an array having an area of 170×170 $mm^2$ The sound pressure at the peak of the focal point is 2585 Pa RMS (measured) when the focal length R=200 mm. In another embodiment in accordance with the present invention, an ultrasonic phased array 40 has a frequency of 25 kHz and consists of 100 transducers, each of which has a diameter of 16 mm. An exemplary 25-kHz transducer bears model number T2516A1 and is manufactured by Nippon Ceramic Co., Ltd. The sound pressure at the peak of the focal point is 900 Pa RMS (estimated) when the focal length R=200 mm. Using a 25-kHz phased array, the sound pressure is much smaller than would be the case if using a 40-kHz phased array, but the size of the focal point is larger than would be the case if using a 40-kHz phased array. In presently preferred embodiments in accordance with the present invention, the ultrasonic phased arrays 20 are 40-kHz phased arrays.

Figure 6:
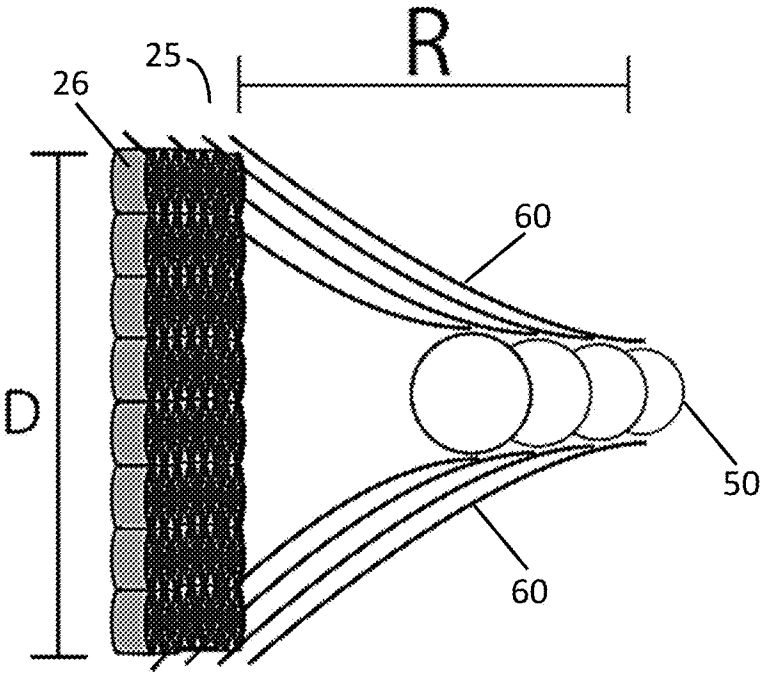
FIG. 6 shows the generation of a focal line by an ultrasonic phased array in accordance with the embodiments of the present invention.

Referring to FIG. 6, a focal point 50 of ultrasound is generated as follows. The time delay $\Delta t_{ij}$ for the (i, j)-th transducer 26 of transducer array 25 is given by:

$$\Delta t_{ij} = \frac{l_{00} - l_{ij}}{c} \tag{2}$$

where $l_{00}$ and $l_{ij}$ are the distances from the focal point to the (0, 0)-th (reference) and the (i, j)-th transducers 26, respectively. The speed of sound in air is c. The focal point 50 can be moved by recalculating and setting the time delays for the coordinates of its next target location.

It has been theoretically and experimentally shown that the spatial distribution of ultrasound generated from a rectangular transducer array is nearly sinc-function-shaped. The width of the main lobe $w_m$ parallel to the side of the rectangular array is written as $$w_m = \frac{2\lambda R}{D} \tag{3}$$

where λ is the wavelength, R is the focal length, and D is the length of the side of the rectangular array. Eq. (3) implies that there is a trade-off between spatial resolution and the array size.

The size of the focal point depends on the frequency of the ultrasound and determines the size of the bodiless mid-air sound source. The diameter of the bodiless mid-air sound source is determined by the width of the ultrasonic beam $w_m$. For example, the size of the focal point is $w_m=2\lambda R/D=15$ mm when the frequency of the ultrasound is 40 kHz, the focal length is 150 mm, and the length of the side of the rectangular array is 170 mm. When the frequency of the ultrasound is 25 kHz, the size of the focal point is $w_m=24$ mm.

The length of the bodiless mid-air sound source is determined by the focal depth $w_d=4\lambda(R/D)^2$. For example, the length of the focal point is $w_d=26.5$ mm when the frequency of the ultrasound is 40 kHz and $w_d=42.4$ mm when the frequency of the ultrasound is 25 kHz. If the diameter and length of the sound source is further different, the shape of the sound source is an ovoid rather than a sphere, and the sound radiation is no longer omni-directional.

The frequency of the ultrasound should be selected based on the intended application. It should be noted that this is a rough guideline for the size of a focal point. A smaller sound source radiates louder sound with fixed ultrasonic power.

Referring to FIG. 3, which shows a more detailed illustration of the system 100, the driving circuitry 21 includes a USB interface 22, a field-programmable gate array FPGA 23, and drivers 24. In one embodiment of the present invention, the USB interface 22 of the driving circuit may be implemented by a USB board that employs an FT2232H Hi-Speed Dual USB UART/FIFO integrated circuit manufactured by Future Technology Devices International Ltd. of Glasgow, UK. The FPGA 23 may be implemented by an FPGA board that includes a Cyclone III FPGA manufactured by Altera Corp. of San Jose, Calif. The drivers 24 may be implemented using push-pull amplifier ICs.

The system controller 10 sends the necessary data, including the spatial coordinates of the focal point (e.g., X, Y, and Z) and the intensity data for each transducer to the driving board 21. The driving circuitry 21 receives this data using the USB interface 22 and provides it to the FPGA 23. The FPGA 23 contains a phase calculator 27 that calculates the appropriate time (or phase) delays for each ultrasonic transducer 26 in the ultrasonic transducer array 25 based on Eq. (2).

Figure 10:
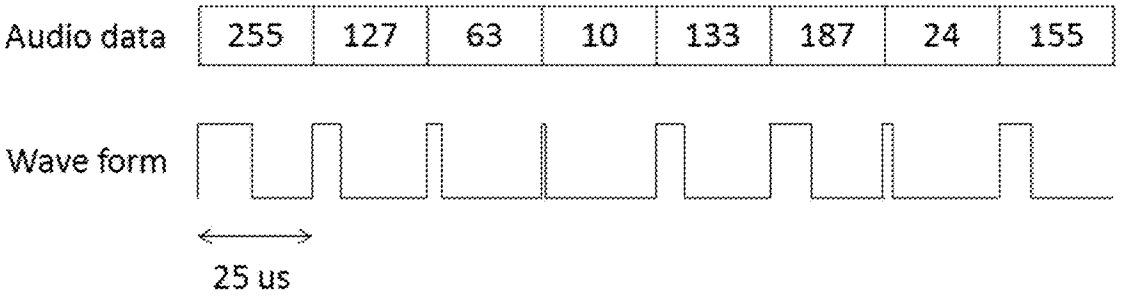
FIG. 10 shows an exemplary waveform of a driving signal that has been modulated with audio data using pulse width modulation.

The intensity data is generated at the system controller 10 based on an audio signal stored in any medium such as HDD/USB memory/SD card/cloud storage and accessible to the system controller 10. Preferably, the intensity data is generated by sampling the audio signal at the same frequency as the ultrasonic carrier frequency. As shown in FIG. 10, in a preferred embodiment with a carrier frequency of 40 kHz, the intensity data is generated by sampling an audio signal at 40 kHz and at 8-bits per sample. The ultrasonic carrier waves are modulated according to the intensity data.

Figure 9:
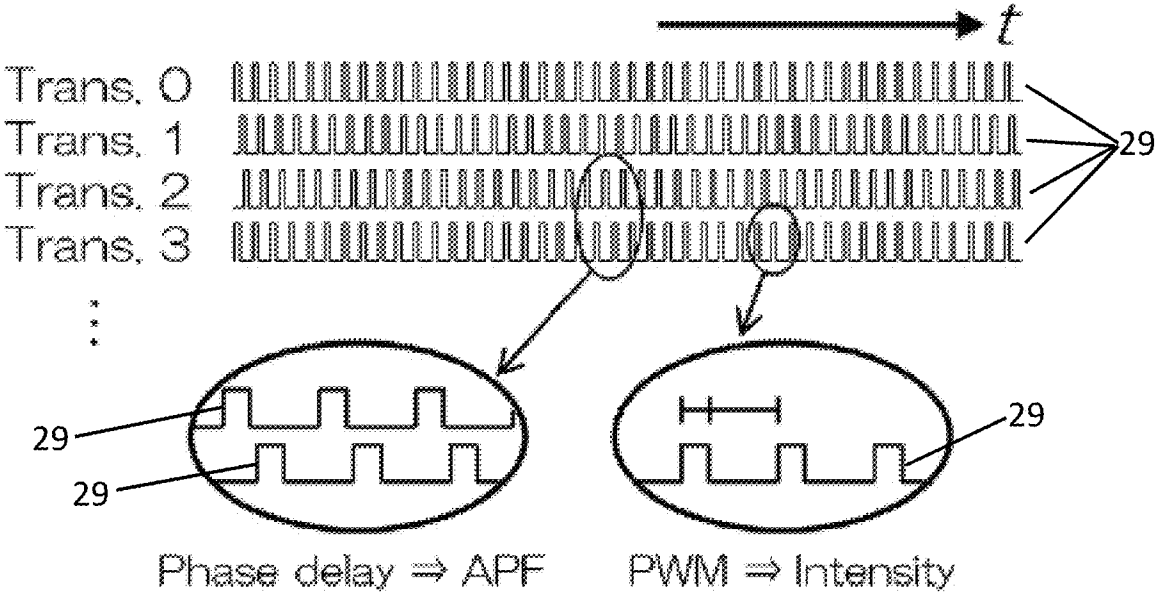
FIG. 9 shows exemplary waveforms of driving signals that are applied to ultrasonic transducers.

The signal generator 28 then generates the driving signal for each transducer in the transducer array 25 based on the time (or phase) delays calculated by the phase calculator 27 and on the intensity data provided by the system controller 10. As shown in FIG. 9, in a preferred embodiment, the output intensity value of each of the transducers 26 is varied using pulse width modulation ("PWM") control of the driving signal 29 that is applied to the transducer based on the intensity data. The width of individual pulses is set based on the sampled 8-bit audio data. The driving signals are then sent to the transducers 26 of the transducer array 25 via the push-pull amplifiers of the drivers 24.

Audible sound in a narrow beam can be generated by using other modulation techniques, including amplitude modulation (AM) and frequency modulation (FM). One of skill in the art would appreciate that additional voltage control ICs are required to implement amplitude modulation. Although the preferred embodiment uses a digital process to modulate the carrier wave, it can be implemented in hardware (analog circuits) with the audio signal as a voltage input. For example, this can be realized by modulating the power supply voltage according to the audio signal. Then, the voltage of the digital driving signal is altered (i.e., amplitude modulation).

The diameter size of an ultrasonic panel affects how effectively ultrasound waves can be focused. A panel of fifty 12V transducers can generate audible sound with sufficient sound pressure. In a preferred embodiment of the present invention, an ultrasonic panel having 285 24V transducers is used. An ultrasonic panel measuring 17×17-cm$^2$ or larger is preferable. Any ultrasonic frequency (>20 kHz) can be used for this purpose. 40-kHz transducers are the most commercially available and so 40 kHz transducers are used in the present embodiments.

In one exemplary embodiment of the present invention, a single ultrasonic phased array is used. A single panel can set a focal point near (e.g., within about 50 cm, preferably within about 10 cm) a target person's ear. With additional phase-delay control, it can set two focal points one near each ear of a target person or it can set multiple focal points near multiple target persons' ears. The same audio signal can be reproduced at each focal point or different audio signals can be reproduced at each focal point. For example, the transducers of each phased array 20 can be divided into groups that are separately controlled. Each group can set a distinct focal point and the ultrasonic waves delivered to that focal point can be modulated with a different audio signal. In another exemplary embodiment of the present invention, multiple panels are used. The preferable number of the ultrasonic panels is determined by the effective distance of the sound source, which is up to 3 m with a 17×17-cm$^2$ panel. A larger panel can set a focal point farther. Multiple panels are needed if the target area is large because the panels have to be directed to the target persons. Multiple panels may also be needed to set a complex distribution of focal points and deliver different audio signals for reproduction.

Figure 7:
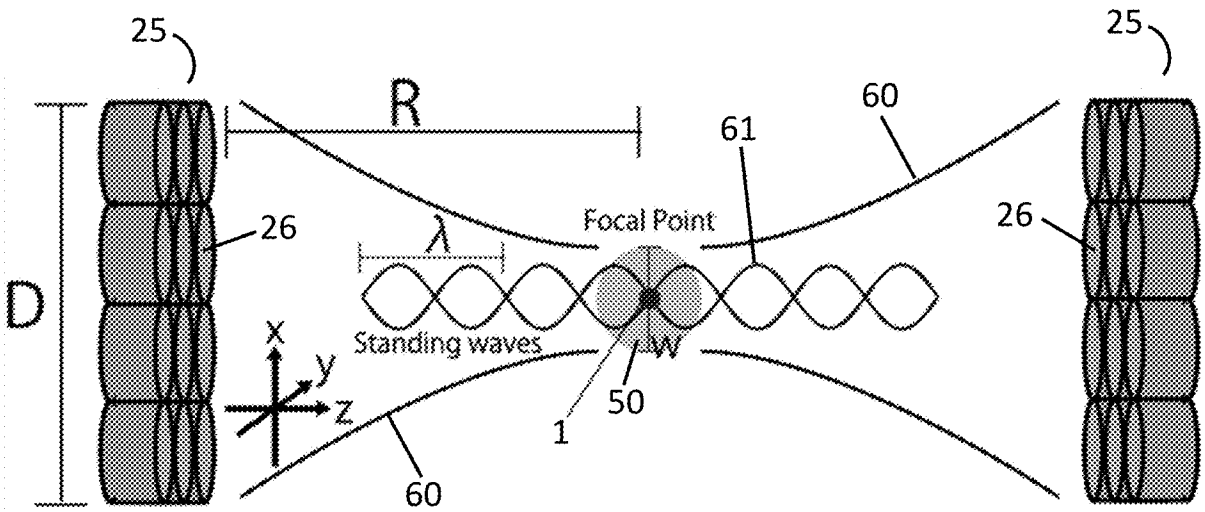
FIG. 7 shows a narrow beam of standing waves generated in the vicinity of a focal point in accordance with the embodiments of the present invention.

Referring to FIG. 7, a focal line of an ultrasound is generated in a similar manner with variation in the target coordinates. In this case, the time delay $\Delta t_{ij}$ for the (i, j)-th transducer 26 in array 25 is given by:

$$\Delta t_{ij} = \frac{l_{0j} - l_{ij}}{c} \tag{4}$$

where $l_{0j}$ and $l_{ij}$ are the distances from the j-th focal point to the (0, j)-th and the (i, j)-th transducers 26, respectively, i.e., each column targets its own focal point 50. The thickness of the focal line is $w_m$, as defined in Eq. (3) above. The peak value of the amplitude of the focal line is lower than that of the focal point because the acoustic energy is distributed over a broader area. When an ultrasonic standing wave is generated, the interval between the focal points is $\lambda/2$, and the size of a focal point is $\lambda/2$ by the width of the ultrasonic beam $w_m$.

Figure 8A:
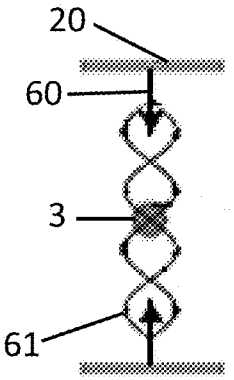
FIG. 8A shows a dot-shaped acoustic field in accordance with embodiments of the present invention.
Figure 8B:
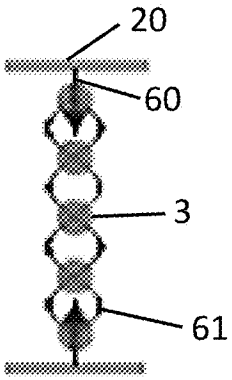
FIG. 8B shows a line-shaped acoustic field in accordance with embodiments of the present invention.

Two types of acoustic fields have been described above: a focal point and focal line. It should be noted that the transducers in the phased arrays are individually controlled, and can thus generate other distributions of acoustic fields, such as multiple beams. The arrangement of the phased arrays can be used to design the shape of the acoustic field. For example, a single phased array with a reflector, two opposed phased arrays, four opposed phased arrays, or multiple phased arrays surrounding the workspace are used to generate standing waves to form different ultrasound distributions. FIG. 8 shows examples of acoustic field distributions, where the circular particles indicate the local minima 3 (i.e., nodes) formed by standing waves 61 where bodiless mid-air sound sources are formed. FIG. 8A shows a dot-shaped acoustic field created by a pair of ultrasonic phased arrays 20 that each emit a narrow acoustic beam 60. FIG. 8B shows a line-shaped acoustic field created by a pair of ultrasonic phased arrays 20 that each emit a narrow acoustic beam 60. FIG. 8C shows a cross-shaped acoustic field created by two pairs of ultrasonic phased arrays 20 that each emit a narrow acoustic beam 60. FIG. 8D shows a triangle-shaped acoustic field created by three ultrasonic phased arrays 20 that each emit multiple (e.g., two) acoustic beams 60. FIG. 8E shows a square-shaped acoustic field created by two pairs of ultrasonic phased arrays 20 that each emit multiple (e.g., two) acoustic beams 60. FIG. 8F shows a two dimensional grid-shaped ("2D Grid") dot-matrix acoustic field created by two pairs of ultrasonic phased arrays 20 that each emit a wide (i.e., sheet) acoustic beams 160 targeting focal lines at the same position.

Other distributions of acoustic fields that can be generated in accordance with the present invention include acoustic fields having arbitrary shapes, including arbitrary three-dimensional shapes. For example, one or more ultrasonic phased arrays surrounding a workspace can be used to generate standing waves of various shapes to provide acoustic fields having arbitrary shapes.

In accordance with embodiments of the present invention, any desired three-dimensional ultrasound distribution can be generated by ultrasonic computational holography using multiple ultrasonic phased arrays as follows. Bodiless mid-air sound sources can be positioned at various nodes of the acoustic field so that a surround sound system is realized.

The spatial phase control of ultrasound enables the generation of one or more focal points in three-dimensional space for each of the phased arrays. For each phased array, a complex amplitude (CA) of the reconstruction from the computer generated hologram (CGH) $U_r$ is given by the Fourier transform of that of a designed CGH pattern $U_h$:

$$U_r(v_x, v_y) = \int\int U_h(x, y)\exp[-i2\pi(xv_x + yv_y)]dxdy = a_r(v_x, v_y)\exp[i\varphi_r(v_x, v_y)] \quad (5)$$

$$U_h(x, y) = a_h(x, y)\exp[i\varphi_h(x, y)] \quad (6)$$

where $\alpha_h$ and $\varphi_h$ are the amplitude and phase, respectively, of the ultrasonic waves radiated from a phased array. For simplicity, $\alpha_h$ can be constant for all the transducers of the phased arrays. It can be adjusted individually for each transducer if required. $\varphi_h$ is derived by an optimal-rotation-angle (ORA) method. $\alpha_r$ and $\varphi_r$ are the amplitude and phase, respectively, of the reconstruction plane. The spatial intensity distribution of reconstruction is actually observed as $|U_r|^2=\alpha_r^2$. The CGH $U_r$ is a representation of an acoustic field distribution from the perspective of a phased array.

In the control of focusing position along the lateral (XY) direction, the CGH is designed based on a superposition of CAs of blazed gratings with variety of azimuth angles. If the reconstruction has N-multiple focusing spots, CGH includes N-blazed gratings. In the control of focusing position along the axial (Z) direction, a phase Fresnel lens pattern $$\varphi_p(x, y) = k\frac{x^2 + y^2}{2f}$$

with a focal length f is simply added to $\varphi_h$ where $$k = \frac{2\pi}{\lambda}$$

is a wave number. In this case, the spatial resolution of the phased array determines the minimum focal length.

The ORA method is an optimization algorithm to obtain the reconstruction of CGH composed of spot array with a uniform intensity. It is based on adding an adequate phase variation calculated by an iterative optimization process into the CGH. In the i-th iterative process, amplitude $\alpha_h$ and phase $\varphi_h^{(i)}$ at a pixel (transducer) h on the CGH plane (i.e., phased array surface), and a complex amplitude (CA) $U_r^{(i)}$ at a pixel r corresponding to focusing position on the reconstruction plane are described in the computer as follows, $$U_r^{(i)} = \omega_r^{(i)}\sum_h u_{hr}^{(i)} \quad (7)$$

-continued $$= \omega_r^{(i)}\sum_h a_h\exp[i(\varphi_{hr} + \varphi_h^{(i)})],$$

where $u_{hr}$ is CA contributed from a pixel (transducer) h on the phased array surface to a pixel r on the reconstruction plane, $\varphi_{hr}$ is a phase contributed by the ultrasound propagation from a pixel (transducer) h to a pixel r, $\omega_r^{(i)}$ is a weight coefficient to control the ultrasound intensity at pixel r. In order to maximize a sum of the ultrasound intensity $\Sigma|U_r^{(i)}|^2$ at each pixel r, the phase variation $\Delta\varphi_h^{(i)}$ added to $\varphi_h^{(i)}$ at pixel (transducer) h is calculated using flowing equations.

$$\Delta\varphi_h^{(i)} = \tan^{-1}\left(\frac{s_2}{s_1}\right), \quad (8)$$

$$S_1=\Sigma_r\omega_r^{(i)}\alpha_h\cos(\varphi_r-\varphi_{hr}-\varphi_h^{(i)}), \quad (9)$$

$$S_2=\Sigma_r\omega_r^{(i)}\alpha_h\sin(\varphi_r-\varphi_{hr}-\varphi_h^{(i)}), \quad (10)$$

where $\omega_r$ is the phase at pixel r on the reconstruction plane. The phase of CGH $\varphi_h^{(i)}$ is updated by calculated $\Delta\varphi_h^{(i)}$ as follows.

$$\varphi_h^{(i)}=\varphi_h^{(i-1)}+\Delta\varphi_h^{(i)}, \quad (11)$$

Furthermore, $\omega_r^{(i)}$ is also updated according to the ultrasound intensity of the reconstruction obtained by the Fourier transform of Eq. (11) in order to control the ultrasound intensity at pixel r on the reconstruction plane $$\omega_r^{(i)} = \omega_r^{(i-1)}\left(\frac{I_r^{(d)}}{I_r^{(i)}}\right)^{\alpha} \quad (12)$$

where $I_r^{(i)}=|U_r^{(i)}|^2$ is the ultrasound intensity at pixel r on the reconstruction plane in the i-th iterative process, $I_r^{(d)}$ is an desired ultrasound intensity, and $\alpha$ is constant. The phase variation $\Delta\varphi_h^{(i)}$ is optimized by the above iterative process (Eqs. (8)-(12)) until $I_r^{(i)}$ is nearly equal to $I_r^{(d)}$. Consequently, the ORA method facilitates the generation of a high quality CGH.

Thus, by accurately controlling the sound wave front, an array of ultrasonic transducers can be used to generate complex placement of point sound sources. For example, according to an exemplary embodiment of the invention, referring to Eqs. (7)-(12), amplitude $a_h$ is fixed at 1 while phase $\varphi_h$ is calculated. After the phases are calculated, amplitudes $a_h$ can be modulated according to an audio signal.

When generating standing waves using multiple phased arrays, the CGH $U_r$ to be generated by each phased array depends on its spatial position relative to the other phased arrays. For each phased array, the CGH $U_r$ should be rotated according to the relative position of the phased array in order to obtain a $U_h$ for the phased array. The desired three-dimensional ultrasound distribution is ultimately obtained by superposing the three-dimensional ultrasound distributions provided by each of the ultrasonic phased arrays. In accordance with the embodiments of the present invention, there is provided a system and a method in which the shape of the acoustic field can be controlled in the embodiments in accordance with the present invention.

In accordance with an embodiment of the present invention, the one or more ultrasonic phased arrays 20 together form an acoustic field generator. In another preferred embodiment of system 100, four phased arrays 120 are arranged facing each other. A "workspace" formed by this arrangement of the four phased arrays 20 is 520×520 $mm^2$ In such an arrangement of the four phased arrays 20, a sheet beam of standing wave is generated in the vicinity of a focal point when the four phased arrays 20 surround the workspace and generate focal lines at the same position. Such an acoustic field is described as two beams of standing waves that overlap perpendicular to each other.

Figure 1B:
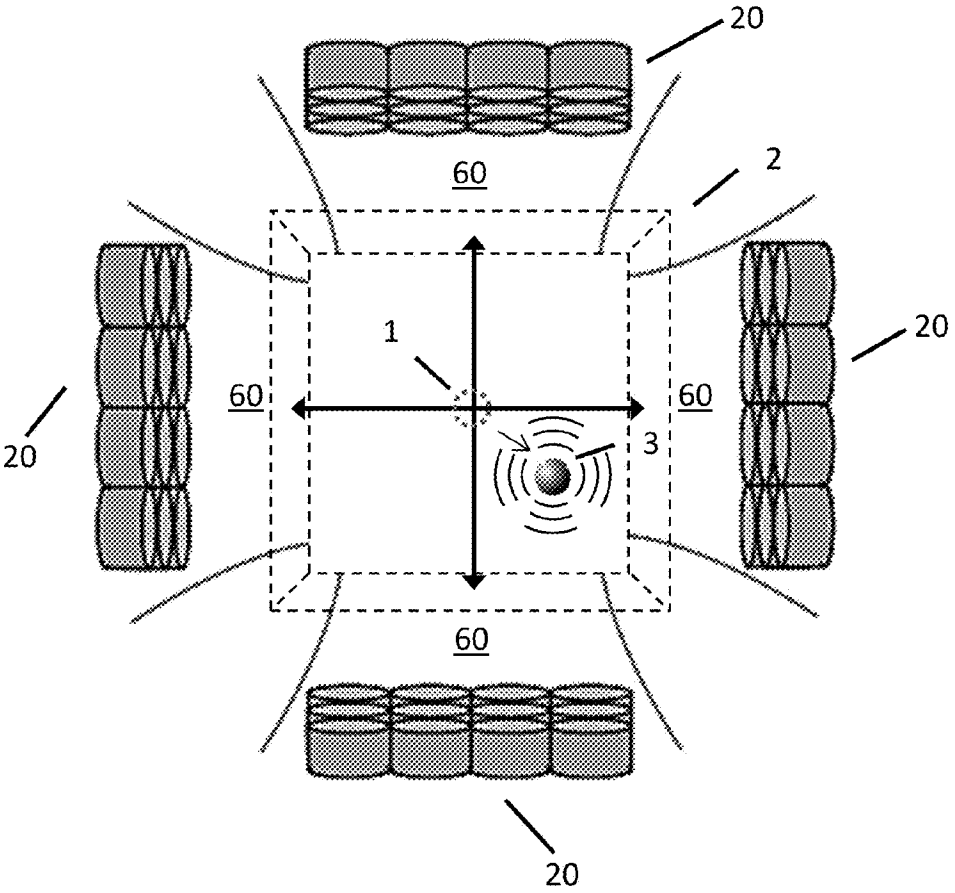
FIG. 1B shows a bodiless mid-air sound source generated at a different focal point in an ultrasonic field in accordance with another embodiment of the present invention.

Furthermore, one or more bodiless mid-air sound sources can be created and manipulated together or separately in a three-dimensional space in the embodiments in accordance with the present invention. These features of the present invention are depicted in FIG. 1B., which shows a bodiless mid-air sound source 1 manipulated by controlling the acoustic field 2 spatially and temporally using acoustic beams 60 so that the bodiless mid-air sound source 1 is moved from one focal point to a different focal point 3 within the acoustic field 2.

The distribution of the focal points that is generated by the one or more ultrasonic phased arrays 20 can be changed by modifying the relative time (or phase) delays for the driving signals 29 that are applied to each of the transducers 26.

In accordance with an embodiment of the present invention, the narrow beams, or the sheet beams, of standing wave are generated in the vicinity of a single target point. The acoustic field changes according to the movement of this target point and then moves the bodiless mid-air sound sources. All of the bodiless mid-air sound sources in the acoustic field can be moved together in the same direction.

The movement of the target point should be as continuous as possible to keep the audio continuously streaming. If the distance between the old and new target points is large, the float mid-air speakers may sound choppy. It should be noted that, although the acoustic field generator has a spatial resolution of 0.5 mm and a refresh rate of 1 kHz in an embodiment of the present invention, the time it takes to demodulate and recover an audio signal limits the speed of their movement.

The embodiments in accordance with the present invention have several characteristics that can prove useful in graphics applications. These characteristics include: (1) multiple bodiless mid-air sound sources can be created and manipulated simultaneously by modification of the acoustic field and (2) sound sources can be rapidly manipulated, resulting in the production of 3D sound corresponding to the motion of graphical elements.

There are several studies that have focused on mid-air displays. For example, there has been disclosed a three-dimensional volumetric display based on laser-excited plasma that generates an image consisting of luminous points. See Yoichi Ochiai et al. 2015. Fairy lights in femtoseconds: aerial and volumetric graphics rendered by focused femtosecond laser combined with computational holographic fields. In *ACM SIGGRAPH* 2015 *Emerging Technologies* (SIGGRAPH '15). ACM, New York, N.Y., USA, Article 10, 1 pages. DOI=http://dx.doi.org/10.1145/2782782.2792492. The embodiments in accordance with the present invention can be used in conjunction with such a display to provide immersive spatial sound.

In yet another alternative embodiment in accordance with the present invention, sound effects can be generated. By changing the spatial position of the focal points of the acoustic field, a mid-air sound source is moved. By moving the mid-air sound sources in the acoustic field quickly, a Doppler effect can be generated.

The results of these experiments showed that the maximum speed of movement of the sound source was about 1000 cm/s under the condition where the sound source moves at an interval of 1 cm (i.e., almost continuous movement compared with the wavelength of audible sound) with 1 kHz refresh rate. This speed is enough to produce a Doppler effect.

In accordance with additional aspects of the present invention, mid-air sound sources offer augment reality experiences. In accordance with embodiments of the present invention, mid-air sound sources can be positioned adjacent real world objects to make it sound like the real world object is emitting sound.

Two factors determine the sustainability of the mid-air sound sources in the acoustic field: power consumption and the heat condition of ultrasonic devices.

The difference in the heat condition of the ultrasonic devices causes a single standing wave to affect the sustainability of the suspension. The temperatures of the ultrasonic devices are equivalent before the devices are turned on. When the ultrasonic devices are turned on, their temperatures gradually increase because of the heat generated by their respective amplifier ICs, whose characteristics are not fully equivalent. When there is such a difference in temperature, the operating frequencies of the controlling circuits of the ultrasonic devices differ. This frequency difference causes the locations of the nodes of the acoustic field to move, and the mid-air sound sources vanish when they reach the edge of the localized standing wave. At the same time, other new sound sources arise at the other edge of the localized standing wave. This can be explained that the sound sources flow in a single direction while the area occupied by them is fixed. Cooling the ultrasonic devices and maintaining the temperature balance between the devices is one treatment for this problem. Another approach is to adjust the phase delays of the transducers of the ultrasonic phased arrays 40 based on feed-forward control.

The intensity of the ultrasound radiated from a single ultrasonic phased array 20 is in proportion to the number of ultrasonic transducers 26 contained therein. Increasing the number of ultrasonic transducers 26 enables louder sounds. In addition to providing a higher intensity, increasing the number of ultrasonic transducers 26 results in other benefits. One such benefit is a larger workspace. Another benefit is smaller dispersion of the phase delay characteristics, which leads to more accurate generation and control of the acoustic field.

In a single wide/narrow acoustic beam of a standing wave, all the mid-air sound sources are manipulated together. Multiple beams are generated by, for example, separating a single phased array into several regions and controlling each region individually. In this way, multiple mid-air sound sources can be controlled individually.

The embodiments in accordance with the present invention have a wide range of setup variations, from 20×20 $cm^2$ to 100 $cm^2$. For example, a 2D Grid acoustic field of the type depicted in FIG. 8F can be arranged with dimensions of 25 cm×25 cm (i.e., each pair of opposing ultrasonic phased arrays 20 is separated by 25 cm), 52 cm×52 cm (i.e., each pair of opposing ultrasonic phased arrays 20 is separated by 52 cm), and 100 cm×100 cm (i.e., each pair of opposing ultrasonic phased arrays 20 is separated by 100 cm). A two-dimensional line acoustic field of the type depicted in FIG. 8B can be arranged with a dimension of 20 cm between ultrasonic phased arrays 20. Larger setups will be possible in the future with larger ultrasonic devices.

As described above, in accordance with certain embodiments of the present invention, 3D sound has been expanded from a fixed system to a dynamic system. Three-dimensional acoustic manipulation technology, using ultrasonic phased arrays, can be used to provide an immersive spatial sound experience. Such embodiments disclosed and described herein have wide-ranging applications, such as 3D sound for virtual reality applications, augmented reality applications, and personal guided audio tours.

The principle of ultrasound-based loudspeaker is that modulated ultrasound whose intensity is effectively high radiates audible sound of modulation frequency. In application, ultrasound can be focused to make an effectively high-intensity ultrasound just around the focal point. Although a generated focal point is not completely spherical, the sound pressure emanating from the focal point can be approximated as a point source by the following equation:

$$p_b(r) = \frac{p_0}{r} e^{j(kr-\omega t)}, \tag{13}$$

where r is the distance from the position of the point source, t is the time, $p_0$ is the sound pressure at the unit distance, k is the wave number and w is the angular frequency of sound. The time component $e^{-j\omega t}$ can be omitted in the calculation in order to focus on the spatial distribution.

The value of $p_0$ is assumed to be equal to 1 because the relative pressure value is sufficient for the analysis.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly and is not to be limited by the foregoing specification.

REFERENCES

1. Yoneyama, M., et al. "The Audio Spotlight: An Application Of Nonlinear Interaction Of Sound Waves To A New Type Of Loudspeaker Design". *J. Acoust. Soc. Am.* 73 (5), May 1983
2. Yoichi Ochiai et al. 2015. Fairy lights in femtoseconds: aerial and volumetric graphics rendered by focused femtosecond laser combined with computational holographic fields. In *ACM SIGGRAPH* 2015 *Emerging Technologies* (SIGGRAPH '15). ACM, New York, N.Y., USA, Article 10, 1 pages. DOI=http://dx.doi.org/10.1145/2782782.2792492
3. JP Patent Application Publication No. 2009-290253

We claim:

1. A method for generating bodiless mid-air speakers comprising the steps of:

generating a modulated signal by modulating an ultrasonic carrier signal with an audio signal;

determining a phase delay value for each ultrasonic transducer of an array of ultrasonic transducers based on the relative position between the ultrasonic transducer and one or more focal points; and driving each ultrasonic transducer of the array of ultrasonic transducers with the modulated signal in accordance with the phase delay value determined for the ultrasonic transducer to focus audible sound at the one or more focal points.

2. The method of claim 1, wherein the phase delay value for each ultrasonic transducer is determined in accordance with equation $U_h(x, y)=a_h(x, y) \exp [i\varphi_h(x, y)]$, where $\varphi_h(x, y)$ represents the phase delay value.

3. The method of claim 1 comprising the additional steps of:

moving the spatial position of one or more focal points;

determining a new phase delay value for each ultrasonic transducer of an array of ultrasonic transducers based on the relative position between the ultrasonic transducer and the one or more focal points; and driving each ultrasonic transducer with the modulated signal in accordance with said new phase delay value determined for the ultrasonic transducer to focus audible sound at the one or more focal points.

4. The method of claim 1, further comprising modulating amplitudes of ultrasound radiated from each ultrasonic transducer according to the audio signal to adjust the volume of the audible sound.

5. A bodiless mid-air speakers generator, comprising:

one or more ultrasonic phased arrays, each ultrasonic phase array comprising:

an array of ultrasonic transducers;

a signal generator that generates a modulated signal by modulating an ultrasonic carrier signal with an audio signal;

a phase delay calculator that determines a phase delay value for each ultrasonic transducer of the array of ultrasonic transducers based on the relative position between the ultrasonic transducer and one or more focal points; and a driving circuit that applies the modulated signal to each ultrasonic transducer in accordance with the phase delay value determined for the ultrasonic transducer to focus audible sound at the one or more focal points.

6. The bodiless mid-air speakers generator of claim 5, wherein the phase delay value for each ultrasonic transducer is determined in accordance with equation $U_h(x, y)=a_h(x, y) \exp [i\varphi_h(x, y)]$, where $\varphi_h(x, y)$ represents the phase delay value.

7. The bodiless mid-air speakers generator of claim 5, further comprising an output power control circuit to modulate amplitudes of ultrasound radiated from each ultrasonic transducer according to the audio signal to adjust the volume of the audible sound.

8. The bodiless mid-air speakers generator of claim 5, wherein the phase delay calculator determines a new phase delay value for each ultrasonic transducer of the array of ultrasonic transducers with respect to any move in the spatial position of the one or more focal points.

* * * * *